United States Patent [19]

Meredith

[11] Patent Number: 5,052,018

[45] Date of Patent: Sep. 24, 1991

[54] ANODE FOR A DIRECT CURRENT ARC FURNACE

[75] Inventor: Dane Meredith, Brandon, Fla.

[73] Assignee: Deutsche Voest-Alpine Industrieanlagen GmbH, Dusseldorf, Fed. Rep. of Germany

[21] Appl. No.: 420,290

[22] Filed: Oct. 12, 1989

[51] Int. Cl.[5] ..... F27D 1/00

[52] U.S. Cl. ..... 373/72; 373/60; 373/85; 373/108

[58] Field of Search ..... 373/108, 109, 102, 60, 373/72, 85, 107; 219/130.1

[56] References Cited

U.S. PATENT DOCUMENTS

| | | | |
|---|---|---|---|
| 4,277,638 | 7/1981 | Stenkvist | 373/108 |
| 4,324,943 | 4/1982 | Stenkvist et al. . | |
| 4,336,411 | 6/1982 | Hanas et al. | 373/85 |
| 4,541,099 | 9/1985 | Rappinger et al. . | |
| 4,549,301 | 10/1985 | Motte et al. | 373/108 |
| 4,618,963 | 10/1986 | Rappinger et al. | 373/108 |
| 4,821,284 | 4/1989 | Janiak et al. . | |
| 4,853,941 | 8/1989 | Rappinger et al. . | |

*Primary Examiner*—Bruce A. Reynolds
*Assistant Examiner*—Tu Hoang
*Attorney, Agent, or Firm*—Locke Reynolds

[57] ABSTRACT

An anode for a d.c. arc furnace is described. The furnace area receiving the melt (2) is provided on the inside with an electrically conductive, refractory lining (8,9,11). The latter is electrically connected to a conductor (12) located on the outside and which has a cylindrical construction and is placed around the electrically conductive lining. The conductor is advantageously fixed to the inside of the steel jacket (3) of the furnace.

25 Claims, 1 Drawing Sheet

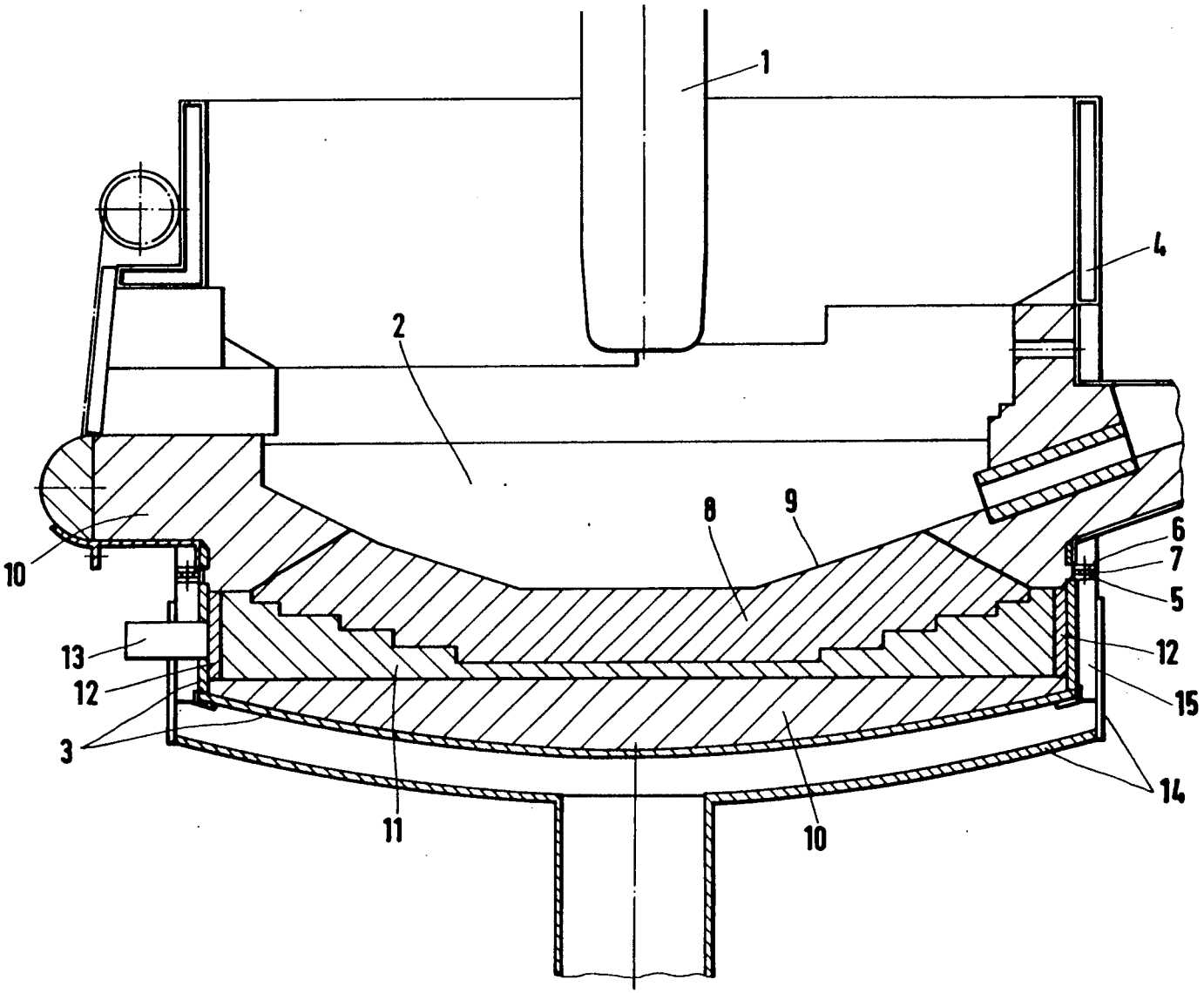
1
2
3
4
5
6
7
8
9
10
10
11
12
12
13
14
15

ANODE FOR A DIRECT CURRENT ARC FURNACE

BACKGROUND OF THE INVENTION

The invention relates to an anode structure for a direct current arc furnace, and particularly to an anode constructed of electrically conducting refractory lining connected to a conductor on the outside of the furnace.

U.S. Pat. No. 4,541,099 discloses a direct current arc furnace with a bottom or hearth contact, in which the hearth or bottom lining of the furnace contains at its contacting face with the melt a ramming mass with electrically conductive metal parts or bricks with sheet metal inserts. To this is connected a first layer of electrically conductive bricks, a second layer of insulating bricks with interposed sheet metal layers or electrically conductive intermediate bricks and finally a third layer of electrically conductive bricks connected to connection contacts. This lining is dome-shaped or planar, it only being in contact with the melt in the bottom area. Quite apart from the fact that this bottom or hearth lining is very complicated and costly to produce, the current passing out from the central arc electrode is led away conically downwards. The areas in the vicinity of the furnace wall are consequently only inadequately supplied with heat, so that cold zones occur here.

U.S. Pat. No. 4,821,284 discloses the use of a steel billet projecting into the melt as the bottom or hearth electrode. In this case the effect of the downwardly directed arc occurs to an even greater extent, so that the arc cone is even more pointed and once again there are cold zones adjacent to the furnace wall. This electrode also requires a water cooling located below the molten metal bath. This causes problems from the safety standpoint.

In another direct current arc furnace known from U.S. Pat. No. 4,324,943 many small diameter metallic conductors are arranged over the entire hearth and are led inwards through the hearth wall. Although this avoids the cold zones in the vicinity of the wall, said distribution leads to concentrated small diameter wear of the refractory lining around the metallic conductors. Thus, dangerous thin points occur in the hearth area, which have to be regularly repaired.

Finally, U.S. Pat. No. 4,853,941 discloses a d.c. arc furnace in which, between a hearth electrode and the melt, is provided a unitary layer of electrically conductive refractory bricks. The bricks are made from a magnesite-graphite material which has been subject to a heart treatment in order to increase the electrical conductivity thereof. As hereagain the electrically conductive lining and the electrode are only positioned in the hearth area, cold zones on the furnace wall cannot be avoided. Moreover, the cooling conditions are unfavourable, so that the electrode is water-cooled.

The problem of the present invention is to provide an anode for a d.c. arc furnace, in which at least part of the furnace area receiving the melt is provided on its inside with an electrically conductive, refractory lining, which is electrically connected to a conductor located on the outside, which has a simple construction, ensures a uniform temperature distribution in the melt and also leads to a uniform wearing of the refractory lining. In addition, the need for water cooling is to be avoided.

SUMMARY OF THE INVENTION

This problem is inventively solved by providing a direct current arc furnace comprising a base including an upstanding perimetral wall. An electrically conductive refractory lining is provided inside the perimetral wall to define, at least in part, a pool for containing a pool of molten metal. A cylindrical conductor is placed around the electrically conducting refractory lining, inside the perimetral wall, and symmetrically located with respect to a cathode extending downward into the center of the pool.

Due to the fact that the conductor is cylindrical and placed around the electrically conductive lining, a symetrical, laterally outwardly directed leading off of the current is ensured, which ensures a uniform and optimum distribution of the current flow through the melt.

The conductor is preferably in the form of a copper ring, which is fixed to the inside of the steel casing or jacket in the lower furnace wall area. As a result there is a large-area contact between the electrically conductive lining and the conductor. This construction also permits an effective air cooling of the conductor.

DESCRIPTION OF THE PREFERRED EMBODIMENT

The invention is described in greater detail hereinafter relative to an embodiment shown in the drawing, which is a diagrammatic sectional representation of a d.c. arc furnace. In the centre of the furnace is provided a vertically extending cathode 1 adjustable in said direction. Between the cathode and the surface of a molten metal bath 2 flow an electric current in the form of an arc. This produces adequate heat to melt metal charged into the furnace and keep it in the molten state.

The furnace has a steel jacket constituted by a lower Part 3 and a cylindrical upper part 4. Lower part 3 and upper part 4 are mechanically interconnected by flanges 5 and 6, and are electrically separated by an insulating intermediate layer 7.

The furnace lining contains a layer of electrically conductive, wear-resistant and refractory bricks 8, which are in contact with the molten metal 2. The unevennesses of the layer surface facing the molten metal caused by the shape of the bricks 8 is compensated by an electrically conductive ramming mass 9. The layer of bricks 8 extends over most of the bottom or hearth area of the furnace.

Electrically conductive, wear-resistant and refractory materials for producing bricks 8 are known, e.g. in the form of carbon-magnesite bricks. The outer lining layer in the hearth area comprise bricks 10 made from electrically insulating, refractory material. Between the insulating layer of bricks 10 in the hearth area and the electrically conductive layer of bricks 8 is provided a layer of bricks 11 having a higher electrical conductivity than bricks 8, but not having the same wear resistance and refractoriness as these. Graphite bricks are preferably used as the bricks 11. The thickness of the layer of bricks 11 increases towards the outer edge. The drawing shows this layer in continuous form, but it can also be omitted in the central hearth area. The graphite bricks should be placed so that the radial direction of the furnace corresponds to the direction of extrusion of the graphite so that electrical resistance is minimized in the radial direction of brick layer 11.

On the inside of the cylindrical portion of lower part 3, a copper ring 12 is plated or in other ways fixed to adjoin the layer of bricks 11. Copper ring 12 can be continuous or, in its circumferential direction, can be subdivided into several segments. Copper conductors 13 are passed through the lower part 3 and connected to the copper ring 12 for power supply purposes.

The lining is formed by a continuous layer of refractory, electrically insulating bricks 10 above copper ring 12 and in the wall area of the furnace.

As a result of the large-area connection between copper ring 12 and the good conducting layer of bricks 11 on the one hand, as well as said layer and the conductive layer of bricks 8 on the other, a large part of the inner surface of the lining in contact with the molten metal 2 is largely at the same potential. Correspondingly there is a distribution of the current flow over virtually the entire surface of the molten metal 2. This minimizes the occurrences of cold zones, particularly in the vicinity of the furnace wall.

The hearth and the lower wall area of the furnace are provided with means for guiding a cooling medium, preferably air. The cooling medium is supplied below the centre of the hewarth and in a carvity delimited by a bottom plate 14 of the hearth is brought radially outwards and by a deflection to the wall area level with the copper ring 12. Cooling ribs 15 projecting radially outwards into the cavity from lower part 3 increase the cooling effect and serve to carry the cooling medium.

For a furnace with a capacity of 60 T and a diameter of approximately 5.2 m, as well as a maximum current intensity of 85,000 A, the copper ring 12 e.g. has a height of about 400–700 mm and a thickness of about 20–60 mm.

It will be appreciated by those skilled in the art that if the statics of the furnace are ensured by a steel framework and not a steel jacket, as a function of the d.c. arc furnace construction, the copper ring can also be fixed to the framework instead of to the jacket. Other variations and modifications exist within the scope and spirit of the invention as described and as defined in the following claims.

What is claimed is:

1. A direct current arc furnace comprising a base including an upstanding perimetral wall, an anode including an electrically conductive refractory lining having a radially outer surface inside the perimetral wall and situated above the base to define, at least in part, a pool for containing a melt of molten metal, a cathode extending downward into the pool, and a substantially continuous cylindrical metal conductor situated inside the perimetral wall and around and contacting the radially outer surface of the electrically conductive refractory lining below the pool to ensure a uniform temperature distribution in the melt.

2. The direct current arc furnace of claim 1 wherein the electrically conductive refractory lining comprises an inner layer defining the pool and an outer layer contacting the conductor, the outer layer having a higher electrical conductivity than the inner layer.

3. The direct current arc furnace of claim 2 wherein the outer layer of the refractory lining decreases in thickness from the conductor toward the center of the furnace.

4. The direct current arc furnace of claim 3 further comprising a layer of electrically insulating refractory materials between the electrically conductive refractory lining and the base.

5. The direct current arc furnace of claim 4 wherein the base comprises a jacket for guiding a cooling medium to a lower part of the furnace.

6. The direct current arc furnace of claim 1 wherein said metal conductor consists essentially of copper.

7. The direct current arc furnace of claim 1 further comprising a steel jacket enveloping the base and the upstanding perimetral wall, the metal conductor being fixed to the steel jacket.

8. The direct current arc furnace of claim 1 further comprising a steel framework enveloping the base and the upstanding perimetral wall, the metal conductor being fixed to the steel framework.

9. The direct current arc furnace of claim 1 wherein said metal conductor is circumferentially continuous.

10. The direct current arc furnace of claim 1 wherein said metal conductor is circumferentially subdivided into at least two segments.

11. The direct current arc furnace of claim 1 further comprising at least one copper conductor connected to an outer surface of said metal conductor.

12. The direct current arc furnace of claim 11 wherein the at least one copper conductor connected to an outer surface of said metal conductor comprises a plurality of copper conductors distributed about the outer circumference of the metal conductor.

13. The direct current arc furnace of claim 1 wherein said electrically conductive refractory lining comprises an inner layer of electrically conductive, wear-resistant and refractory bricks, and an outer layer of electrically conductive, wear-resistant and refractory bricks, the outer layer having a higher electrical conductivity and lower wear-resistance and refractories than the inner layer.

14. The direct current arc furnace of claim 13 wherein said outer layer of bricks consist essentially of graphite.

15. The direct current arc furnace of claim 13 wherein said outer layer of bricks decreases in thickness with increasing distance from said radially outer surface.

16. The direct current arc furnace of claim 15 wherein said outer layer of bricks has a thickness such that a radially outer surface of said outer layer corresponds to dimension to and abuts a radially inner surface of said metal conductor.

17. The direct current arc furnace of claim 13 further comprising a layer of refractory, electrically insulating bricks situated below said electrically conductive refractory lining.

18. The direct current arc furnace of claim 1 further comprising cooling medium supply means for supplying cooling medium to said substantially continuous cylindrical metal conductor.

19. The direct current arc furnace of claim 18 further comprising means for guiding cooling medium adjacent to said base.

20. The direct current arc furnace of claim 18 further comprising outwardly projecting ribs thermally conductively connected to said cylindrical metal conductor for interaction with said cooling medium supplied by the cooling medium supply means.

21. A direct current arc furnace comprising;

a base including a jacket for guiding a cooling medium to a lower part of the furnace and an upstanding perimetral wall, an anode including an electrically conductive refractory lining provided inside the perimetral wall, the lining including an inner layer defining a pool for containing a melt of molten metal and an outer layer having a higher electrical conductivity than the inner layer, the outer layer having a generally cylindrical outer surface adjacent the perimetral wall and decreasing in thickness with increasing distance from the generally cylindrical outer surface, a layer of electrically insulating refractory materials between the electrically conductive refractory lining and the base, a cathode extending downward into the pool, and a substantially continuous cylindrical metal conductor situated around the generally cylindrical outer surface of the electrically conductive refractory lining below the pool, and electrically connected to the outer layer to ensure a uniform temperature distribution in the melt.

22. A direct current arc furnace comprising;

a base and an upstanding perimetral wall, an anode including an electrically conductive refractory lining provided inside the perimetral wall, the lining including an inner layer defining a pool for containing a melt of molten metal and an outer layer having a higher electrical conductivity than the inner layer, the outer layer having a generally cylindrical outer surface adjacent the perimetral wall and decreasing thickness with increasing distance from the cylindrical outer surface, a cathode extending downward into the pool, and a substantially continuous cylindrical conductor situated around the generally cylindrical outer surface of the electrically conductive refractory lining below the pool and electrically connected to the outer layer to ensure a uniform temperature distribution in the melt.

23. The direct current arc furnace of claim 22 wherein said inner layer of the refractory lining comprises an inner layer of electrically conductive, wear-resistant and refractory bricks, and said outer layer of the refractory lining comprises an outer layer of electrically conductive, wear-resistant and refractory bricks, the outer layer of refractory bricks having a lower wear-resistance and refractoriness than the inner layer.

24. The direct current arc furnace of claim 23 wherein said outer layer of the refractory lining has a thickness such that said generally cylindrical outer surface of said outer layer corresponds in dimension to and abuts a radially inner surface of said substantially continuous cylindrical conductor.

25. The direct current arc furnace of claim 24 further comprising a layer of refractory, electrically insulating bricks situated below said electrically conductive refractory lining and above said base.

* * * * *